US005965999A

United States Patent [19]

Frank

[11] Patent Number: 5,965,999

[45] **Date of Patent: *Oct. 12, 1999**

[54] VERTICAL GENERATOR ASSEMBLY

[75] Inventor: Kenneth M. Frank, Kearney, Nebr.

[73] Assignee: Coleman Powermate, Inc., Kearney, Nebr.

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,593

[22] Filed: Mar. 20, 1997

[51] Int. Cl.[6] ..... F02F 7/00; F02B 63/04

[52] U.S. Cl. ..... 322/1; 310/91; 310/157; 310/58; 290/1 B; 60/39.31

[58] Field of Search ..... 322/1; 60/39.31; 123/2, 3; 290/1 B; 310/91, 89, 58, 157

[56] References Cited

U.S. PATENT DOCUMENTS

| | | | |
|---|---|---|---|
| D. 203,443 | 1/1966 | Sudmeier | D26/5 |
| 2,543,541 | 2/1951 | Angle | 290/1 |
| 3,259,752 | 7/1966 | Honda | 290/1 |
| 3,894,254 | 7/1975 | Holther | 310/66 |
| 4,009,405 | 2/1977 | Gleichman | 310/58 |
| 4,284,913 | 8/1981 | Barnhardt | 310/54 |
| 4,540,888 | 9/1985 | Drewry et al. | 290/1 R |
| 4,677,940 | 7/1987 | Bracht et al. | 123/2 |
| 4,721,070 | 1/1988 | Tanaka et al. | 123/2 |
| 4,779,905 | 10/1988 | Ito et al. | 290/1 B |
| 4,856,470 | 8/1989 | Ishii et al. | 123/195 C |
| 4,859,886 | 8/1989 | Tanaka et al. | 310/51 |
| 4,885,492 | 12/1989 | Van Sickle | 310/113 |
| 4,907,546 | 3/1990 | Ishii et al. | 123/41.56 |
| 4,926,108 | 5/1990 | Schooley et al. | 322/15 |
| 5,011,442 | 4/1991 | Polcz et al. | 440/900 |
| 5,095,701 | 3/1992 | Nakano | 60/521 |
| 5,121,715 | 6/1992 | Nogami et al. | 123/47.1 |
| 5,469,820 | 11/1995 | Data et al. | 123/129.2 |
| 5,515,816 | 5/1996 | Ball et al. | 123/41.7 |
| 5,546,901 | 8/1996 | Acker et al. | 123/195 C |
| 5,626,105 | 5/1997 | Locke et al. | 123/3 |

OTHER PUBLICATIONS

SAE Recommended Practice "Mounting Flanges and Power Take–off Shafts for Small Engines—SAE J609a" pp. 26.26 & 26.27, Jul. 1965.

Campbell Hausfeld catalog page for PoweReach Generator dated Aug., 1996.

*Primary Examiner*—Nestor Ramirez
*Assistant Examiner*—Burton Mullins
*Attorney, Agent, or Firm*—Kramer, Levin, Naftalis & Frankel LLP

[57] ABSTRACT

A vertical generator assembly includes an engine having an engine housing and a vertical drive shaft extending downwardly from the engine housing. A support frame is attached to the bottom of the engine housing, and a stator is attached to the bottom of the support frame. A rotor is mounted within the stator and is attached to the drive shaft. A generator housing is attached to the support frame and encloses the stator and rotor.

55 Claims, 6 Drawing Sheets

VERTICAL GENERATOR ASSEMBLY

BACKGROUND

This invention relates to electric generators, and, more particularly, to an electric generator which is driven by an internal combustion engine having a vertical drive shaft.

Although some electrical generators have used vertical shaft engines, most electrical generators have used horizontal shaft engines. A vertical shaft engine, similar to engines used on lawn mowers, provides an opportunity to use a lower cost engine because of higher volume production of vertical shaft engines.

Commercial prior art generators which have used vertical shaft engines generally include a special mounting flange for adapting the generator head to the engine. The engine adapter not only adds cost but increases the height of the generator assembly.

U.S. Pat. No. 5,546,901 describes a vertical engine which is said to be connectable to a standard generator. I am not aware of a commercial generator which is made in accordance with that patent.

U.S. Pat. No. 4,677,940 describes a vertical generator having a shroud and a cooling system for cooling the generator and the engine.

SUMMARY OF THE INVENTION

The invention attaches a generator to a standard vertical engine without a special engine adapter. The standard engine mounting flange is bolted to the top of a support frame, and the stator of the generator is bolted to the bottom of the frame. The rotor is attached to the drive shaft, and a generator housing encloses the rotor and stator and is bolted to the bottom of the frame. The rotor includes a fan which is positioned below the stator. Cooling air is drawn by the fan through inlet openings in the top of the housing and is expelled through outlet openings in the bottom of the housing. A gasket between the stator and the housing directs the air flow and prevents recirculation of air within the housing. The air inlet openings are shielded from the engine by the generator housing, and the inlet and outlet openings are located on opposite sides of the housing.

DESCRIPTION OF THE DRAWINGS

The invention will be explained in conjunction with the accompanying drawings, in which.

DESCRIPTION OF SPECIFIC EMBODIMENT

Figure 1:
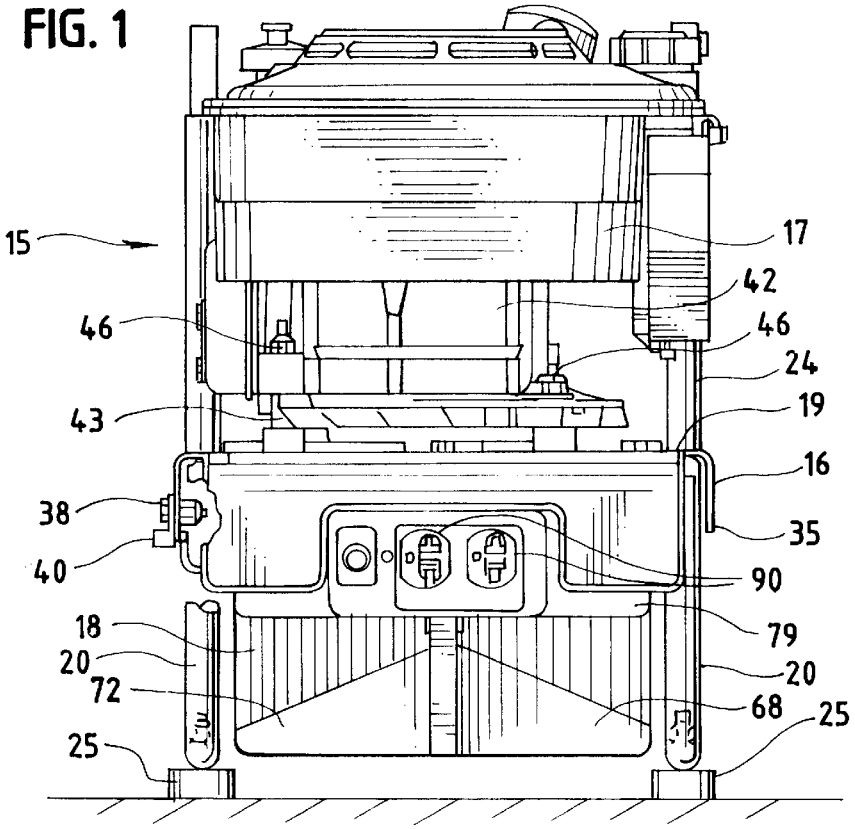
FIG. 1 is a front view, partially broken away, of a vertical generator assembly formed in accordance with the invention.
Figure 2:
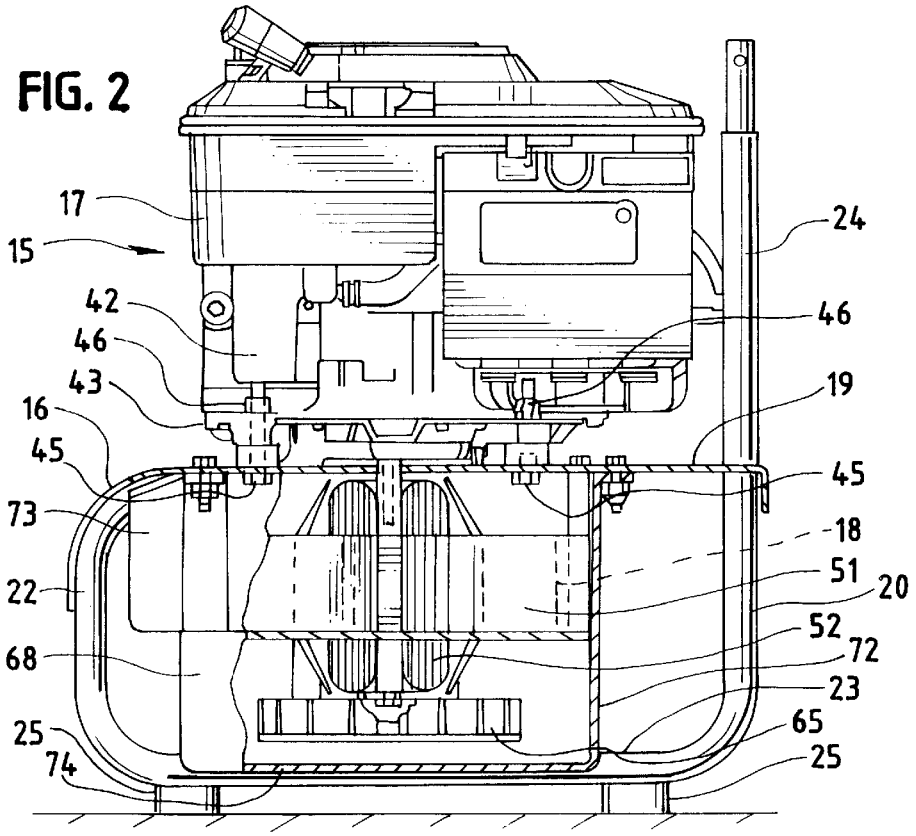
FIG. 2 is a side view, partially broken away, of the generator assembly.

Referring to FIGS. 1 and 2, a generator assembly 15 includes a support frame 16, a vertical engine 17 mounted on top of the support frame, and a generator 18 mounted below the support frame.

The support frame 16 includes a horizontal plate 19 and a pair of tubular support legs 20. Each support leg includes a top horizontal portion 21 (FIG. 5) which supports the plate and which is bolted to the plate, a front vertical portion 22, a bottom horizontal portion 23, and a rear vertical portion 24.

Figure 3:
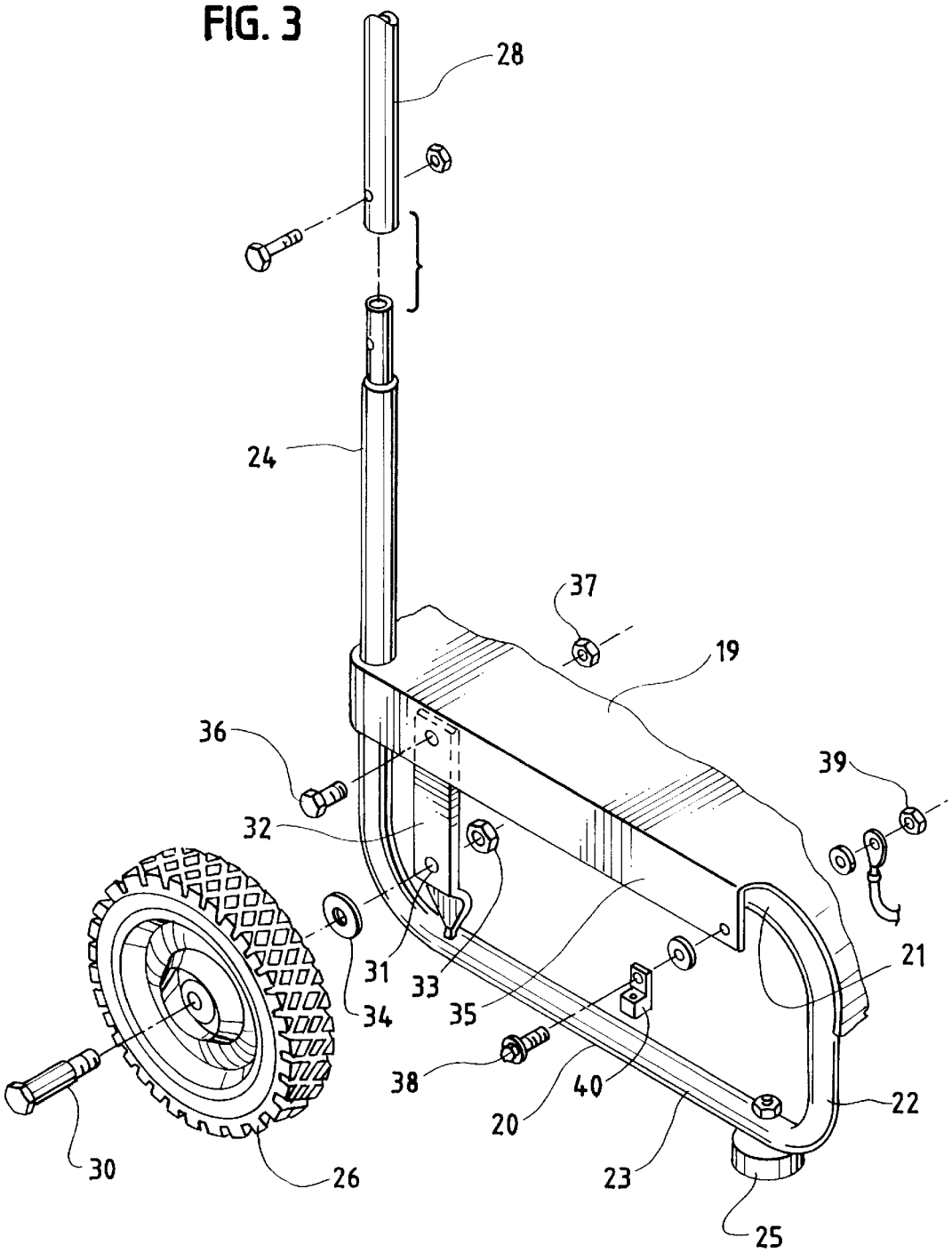
FIG. 3 is an exploded fragmentary perspective view showing how wheels can be mounted on the support frame.

The support frame can be supported either by four rubber foot pads 25 which are bolted to the legs (FIG. 2) or by two rubber foot pads 25 and two wheels 26 (FIG. 3). When four rubber feet are used, a carry handle 27 (FIGS. 4 and 5) is attached to the upper ends of the rear vertical portions 24 of the legs. When wheels are used, an elongated cart handle 28 (FIGS. 3–5) is attached to the legs.

Referring to FIG. 3, each wheel 26 is rotatably supported by a bolt or axle 30 which extends through an opening 31 in a wheel bracket 32. A nut 33 is screwed onto the end of the bolt, and a washer 34 is mounted between the wheel and the bracket. The upper end of the bracket is secured to a side flange 35 of the plate 19 by a bolt 36, which also extends through the top portion 21 of the support leg, and by nut 37. The front end of the side flange 35 is secured to the support leg by bolt 38 and nut 39. A ground lug 40 is also attached by the bolt 38.

The engine 17 can be a conventional lawn mower engine. The engine includes an engine housing 42 (FIG. 5) having a bottom mounting flange 43 which provides a bottom wall and a vertically extending drive shaft 44 which extends below the bottom wall. The drive shaft extends through an opening in the horizontal plate 19 of the support frame, and the engine housing is attached to the plate 19 by bolts 45 and nuts 46. The bolts pass through lock washers 47, engine mounts or spacers 48, and washers 49. The bolts 45 can be used with the standard mounting holes in the mounting flange 43 which are used in lawn mower applications.

Figure 5:
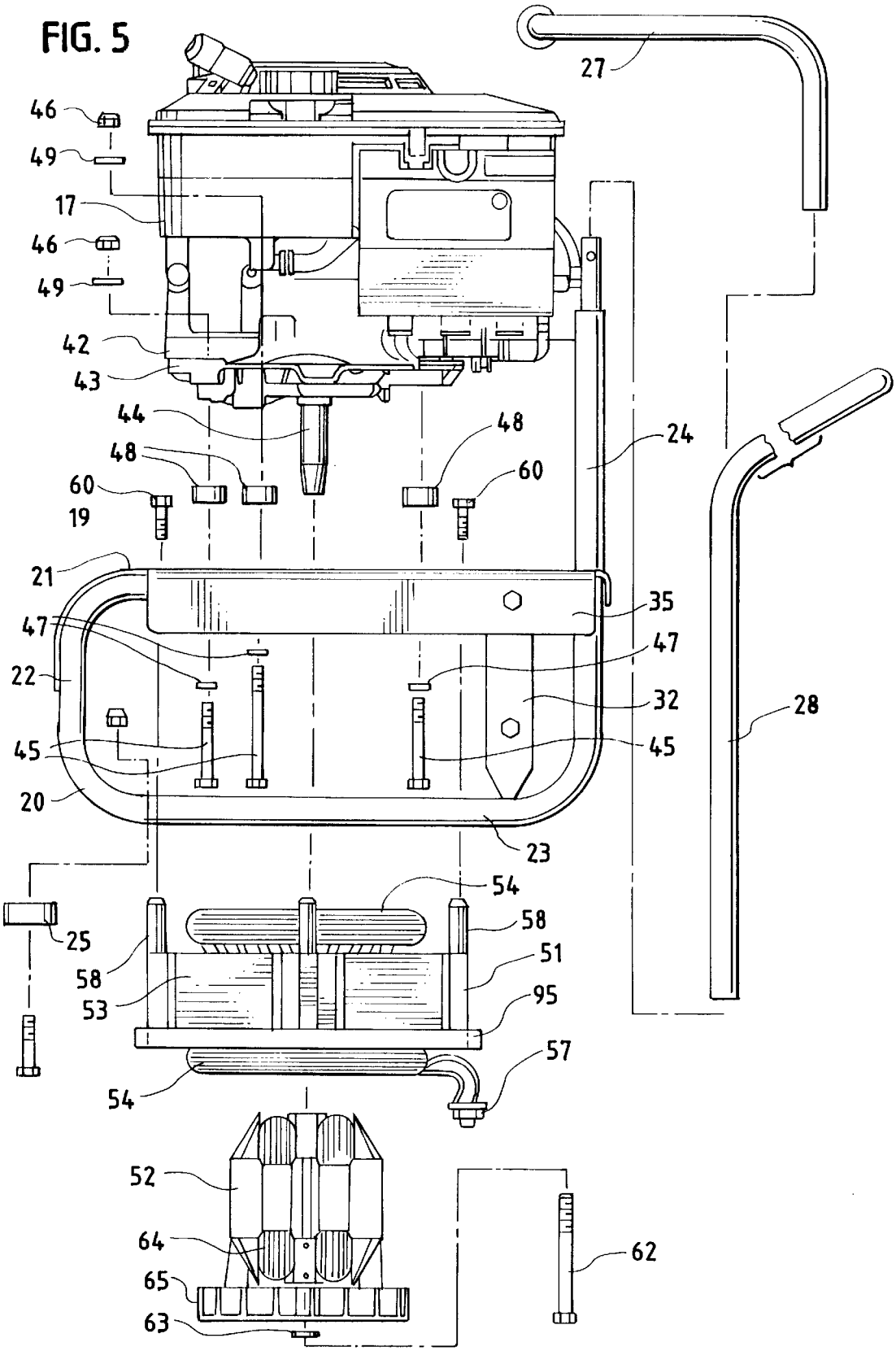
FIG. 5 is an exploded side view, partially broken away, of the generator assembly.
Figure 6:
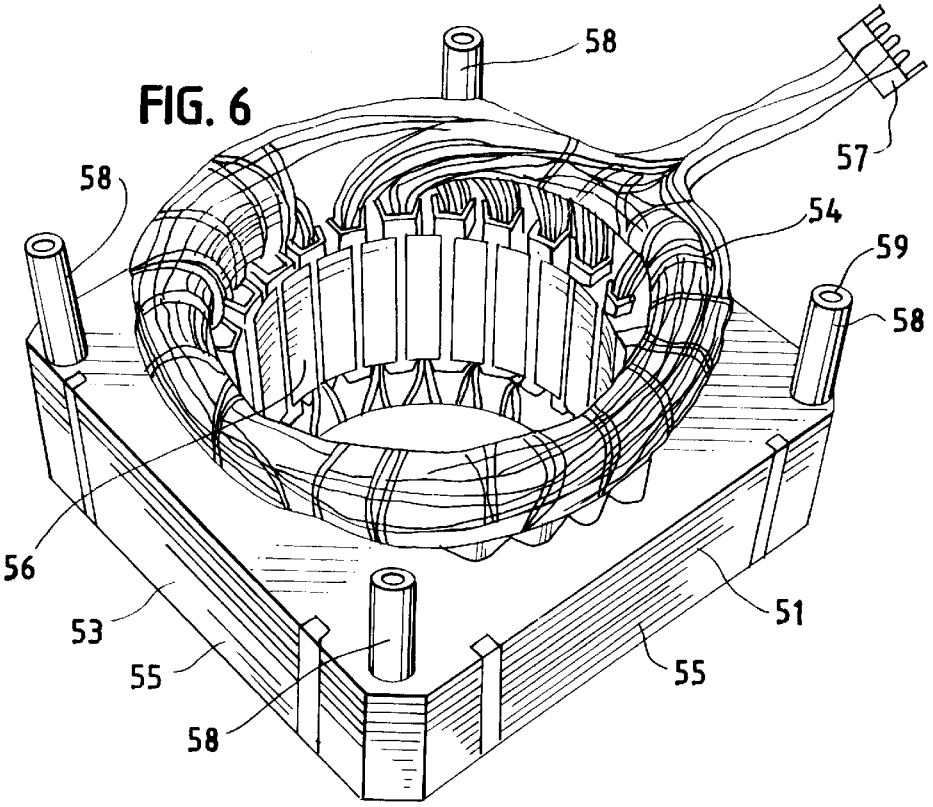
FIG. 6 is a top perspective view of the stator.
Figure 7:
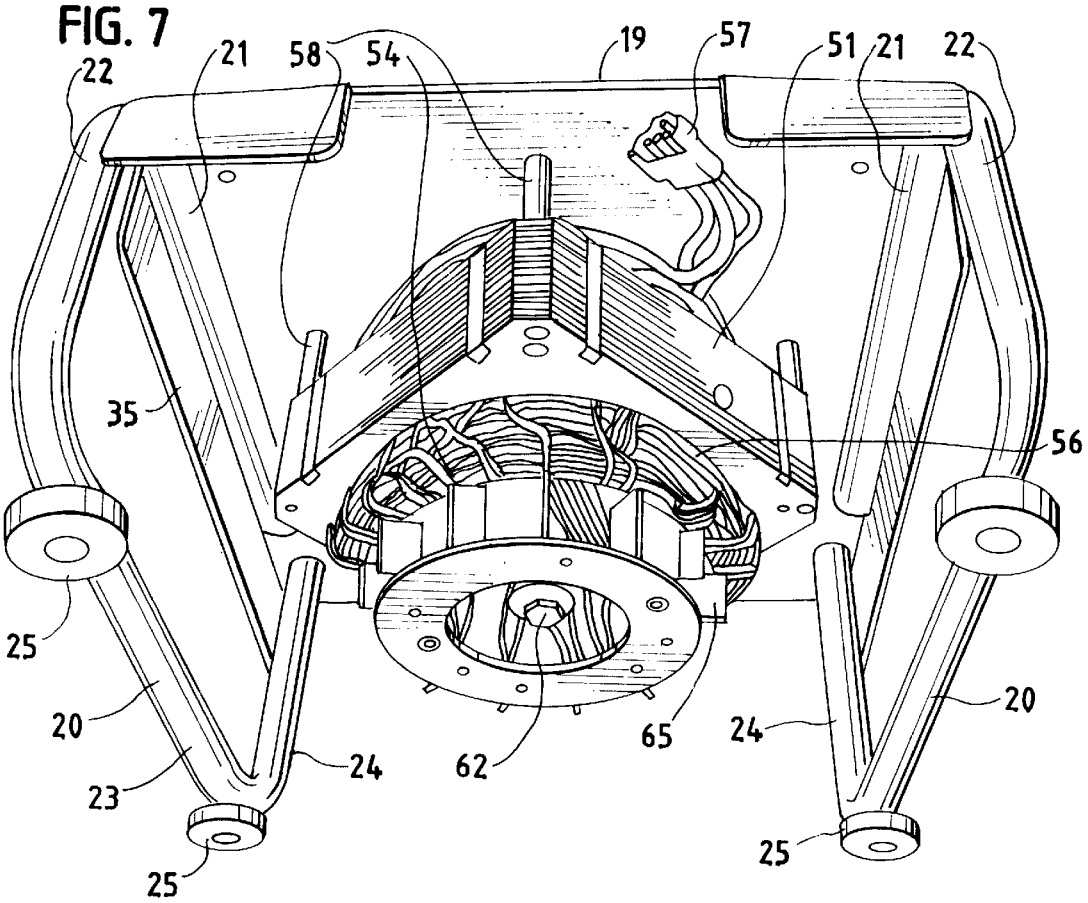
FIG. 7 is a bottom perspective view of the generator assembly with the generator housing removed.

The generator 18 includes a stator 51 and a rotor 52 (FIGS. 5–7). The stator includes a block 53 of laminated magnetic plates and windings 54. The block 53 has a generally rectangular outer periphery provided by four generally flat side surfaces 55 and a central opening 56. The windings 54 are connected to a pin connector 57.

Four mounting tubes 58 are press fitted into holes in the top of the stator. Each mounting tube has a threaded opening 59. The stator is attached to the horizontal plate 19 of the support frame by bolts 60 (FIG. 5) which pass through openings in the plate into the mounting tubes 58.

The rotor 52 is inserted into the central opening of the stator, and the drive shaft 44 extends into a central opening in the rotor. The rotor is secured to the drive shaft by a bolt 62 and a lock washer 63.

The rotor includes windings 64 and a fan 65 which is mounted below the windings. When the rotor is attached to the drive shaft, the fan 65 is positioned below the stator (FIGS. 2 and 7).

The stator is preferably attached to the mounting plate 19 before the engine. The engine can then be properly aligned by snugly mounting a dummy rotor with an oversized outer diameter in the stator. The engine is aligned by inserting the drive shaft into the dummy rotor. When the dummy rotor is removed and replaced with the rotor 52, the proper air gap is maintained between the rotor and the stator.

Figure 4:
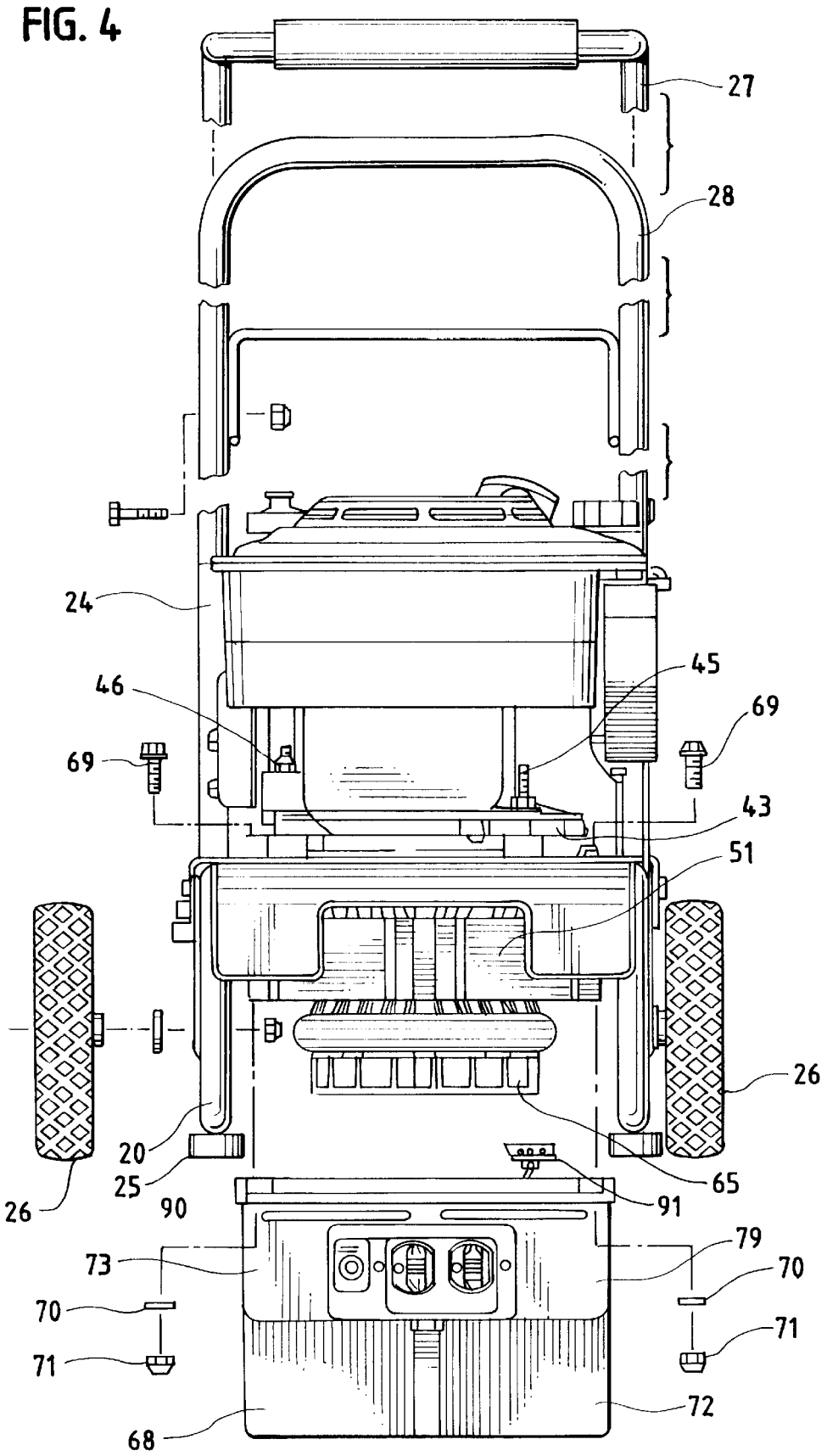
FIG. 4 is an exploded front view, partially broken away, of the generator assembly.

The stator and rotor are enclosed by a generator housing or end bell 68. The generator housing is attached to the horizontal plate 19 by bolts 69, lock washers 70, and nuts 72 (FIG. 4).

Figure 8:
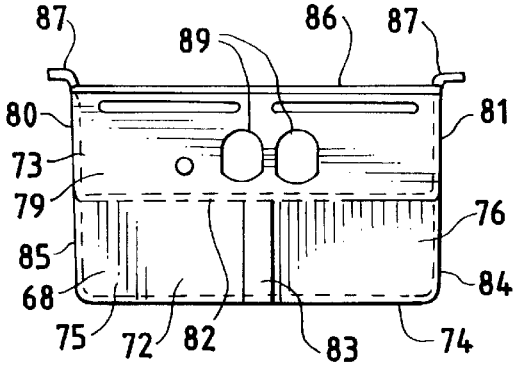
FIG. 8 is a front view of the generator housing.
Figure 9:
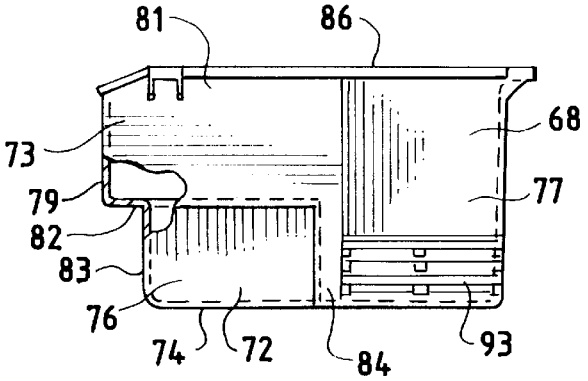
FIG. 9 is a side view, partially broken away, of the generator housing.
Figure 10:
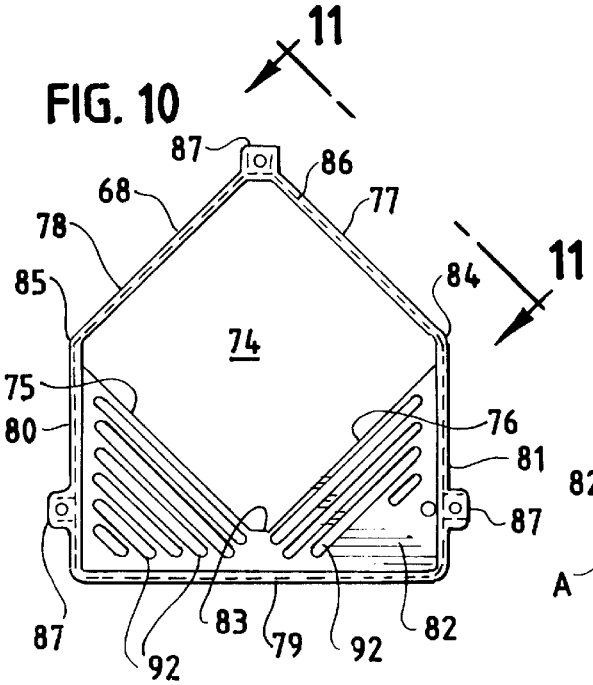
FIG. 10 is a top view of the generator housing.

Referring to FIGS. 8–10, the generator housing 68 includes a generally rectangular lower portion 72 and an open upper portion 73. The lower portion includes a bottom wall 74 and four side walls 75–78 which form a rectangular enclosure for the rectangular stator.

The upper portion includes a flat front wall 79, a pair of rearwardly extending side walls 80 and 81, and a horizontal bottom or connecting wall 82. The front wall 79 extends across the front corner 83 formed by the bottom side walls 75 and 76. The front wall extends parallel to a diagonal between the two side corners 84 and 85.

The bottom side walls 75 and 76 merge with the horizontal connecting wall 82, and the side walls 77 and 78 extend upwardly to the top edge 86 of the housing. Three mounting lugs 87 extend outwardly from the top edge of the bolts 69.

The front wall 79 is provided with a pair of openings 89 for receiving a pair of outlet receptacles 90 (FIGS. 1–4) for connecting the generator to a power cord. The receptacles are connected to the stator windings by a socket 91 (FIG. 4) which connects to the pin connector 57. A conventional circuit breaker and excitation capacitor can also be mounted in the generator housing.

A plurality of air inlet openings or louvers 92 (FIG. 10) are provided in the horizontal connecting wall 82. Air outlet openings or louvers 93 (FIG. 9) are provided in the lower portions of side walls 77 and 78.

Figure 11:
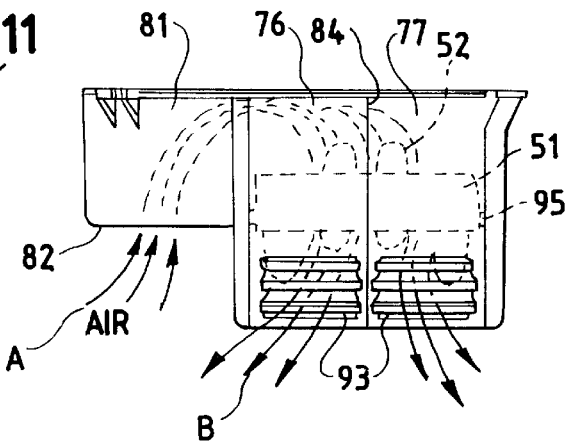
FIG. 11 shows the air flow through the generator.

The rectangular side walls 75–78 of the generator housing are sized to fit relatively snugly around the rectangular stator 51 as shown in FIG. 2. An air seal between the stator and the side walls of the generator housing is formed by a foam rubber gasket 95 (FIG. 4) which extends around the four sides of the stator block. As the rotor 52 and fan 65 are rotated by the engine, the fan draws cooling air into the generator housing through the air inlets 92 and expels air through the air outlets 93 as indicated by the arrows A and B in FIG. 11. The gasket 95 prevents air from passing between the stator 51 and the generator housing and directs the air to flow through the air gap between the rotor and the stator, thereby cooling the coils of the rotor and stator. The gasket 95 prevents air which passes through the air gap from recirculating within the housing.

The shape of the generator housing protects the air inlet openings 92 from being influenced by a temperature rise above ambient air temperature by hot exhaust from the engine and by exhaust from the outlet openings 93. The air inlet openings 92 are provided in the horizontal wall 82 of the generator housing which is shielded from the engine by the upper portion 73 of the housing. The outlet openings 93 are provided in the lower portions of the rearwardly facing side walls 77 and 78 whereas the inlet openings 92 are positioned forwardly of the forwardly facing side walls 75 and 76. The inlet openings and outlet openings are thereby positioned on opposite sides of the generator housing, reducing the likelihood that exhausted air will reach the inlet openings.

The generator housing completely covers the rotor and the stator. The stator therefore need not be painted, which results in additional cost savings. The vertical design also eliminates any need for a third bearing in the generator housing.

The vertical dimension of the generator housing can be selected so that different stator and rotor stack heights can be used with the same generator housing. The power capability of the generator can therefore be varied without changing the generator housing.

The design will accommodate both brush type and brushless generators. Further, by using additional receptacles and making stator winding changes, the generator assembly can be adapted for all international markets which require 50/60 Hz 200–240 volts A.C. Additional refinements and options such as a battery charger, idle control, electronic voltage regulation, GFCI protection, and load demand governer can also be included.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A vertical generator assembly comprising:

an engine including an engine housing and a vertical drive shaft, the engine housing having a bottom wall including a flange having a standard lawn mower engine mounting configuration and an opening in the bottom wall, the vertical drive shaft extending downwardly through the opening in the bottom wall, a support frame located below the bottom wall of the engine housing and including a top wall having top and bottom surfaces and an opening therethrough, the top surface facing toward the bottom wall of the engine housing, and the drive shaft of the engine extending through the opening in the top wall of the support frame, a plurality of fasteners attaching the top wall of the support frame to the flange of the engine housing, a stator located below the top wall of the support frame and having a central opening, a plurality of fasteners attaching the stator to the top wall of the support frame, a rotor positioned within the central opening of the stator and attached to the drive shaft of the engine, and a generator housing attached to the top wall of the support frame by a plurality of fasteners, such that the generator housing and the top wall of the support frame enclose the rotor and the stator.

2. The generator assembly of claim 1, wherein the rotor includes a fan positioned below the stator.

3. The generator assembly of claim 2, wherein the generator housing includes an air inlet opening and an air outlet opening, and means for directing air flow from the air inlet opening, through the central opening in the stator, and through the air outlet opening.

4. The generator assembly of claim 3, wherein said air flow directing means includes a gasket disposed between the stator and the generator housing.

5. The generator assembly of claim 1, wherein the stator includes four sides which provide a generally rectangular periphery, and the generator housing includes an outer wall which provides a generally rectangular enclosure which surrounds the stator, the outer wall having an air inlet opening that allows air to flow through the outer wall and toward at least one of the sides of the stator and an air outlet opening that allows air to flow away from the stator and through the outer wall, the air inlet opening and the air outlet opening being on different sides of the stator.

6. The generator assembly of claim 5, further comprising a gasket disposed between the stator and the generator housing, said gasket directing air from the air inlet opening, through the central opening in the stator, and through the air outlet opening.

7. The generator assembly of claim 5, wherein the generator housing includes a bottom wall which extends below the stator and the rotor.

8. The generator assembly of claim 1, wherein the engine mounting configuration is asymmetrical.

9. A vertical generator assembly comprising:

an engine including an engine housing and a vertical drive shaft, the engine housing having a bottom wall including a flange having a standard lawn mower mounting configuration and the vertical drive shaft extending downwardly through the bottom wall, a support frame attached to the flange of the engine housing, a stator attached to the support frame and having a central opening, the stator having an upper end facing the support frame and a lower end, a rotor positioned within the central opening of the stator and attached to the drive shaft of the engine, the rotor including a fan positioned below the lower end of the stator, and a generator housing enclosing the rotor and the stator.

10. The generator assembly of claim 9, wherein the generator housing includes an air inlet opening and an air outlet opening, and means for directing air flow from the air inlet opening, through the central opening in the stator, and through the air outlet opening.

11. The generator assembly of claim 10, wherein said air flow directing means includes a gasket disposed between the stator and the generator housing.

12. The generator assembly of claim 9, wherein the engine mounting configuration is asymmetrical.

13. A vertical generator assembly comprising:

an engine including an engine housing and a vertical drive shaft, the engine housing having a bottom wall including a flange having a standard lawn mower mounting configuration and the vertical drive shaft extending downwardly through the bottom wall, a stator mounted below the bottom wall of the engine housing and having a central opening, a rotor positioned within the central opening of the stator and attached to the drive shaft of the engine, the rotor including a fan, a generator housing enclosing the rotor and the stator and having an air inlet opening and an air outlet opening, and means for directing air flow from the air inlet opening, through the central opening of the stator, and through the air outlet opening wherein said air directing means includes a gasket disposed between the stator and the generator housing.

14. The generator assembly of claim 13, wherein the engine mounting configuration is asymmetrical.

15. A vertical generator assembly comprising:

an engine including an engine housing and a vertical drive shaft, the engine housing having a bottom wall including a flange having a standard lawn mower mounting configuration and the vertical drive shaft extending downwardly through the bottom wall, a stator mounted below the bottom wall of the engine housing and having a central opening, the stator including four sides which provide a generally rectangular periphery, a rotor positioned within the central opening of the stator and attached to the drive shaft of the engine, the rotor including a fan, a generator housing enclosing the rotor and the stator and having an air inlet opening and an air outlet opening, the generator housing including an outer wall which provides a generally rectangular enclosure which surrounds the stator, the air inlet opening and the air outlet opening of the generator housing being located on different sides of the stator, and means for directing air flow from the air inlet opening, through the central opening of the stator, and through the air outlet opening.

16. A vertical generator assembly comprising:

an engine including an engine housing and a vertical drive shaft, the engine housing having a bottom wall including a flange having a standard lawn mower mounting configuration and the vertical drive shaft extending downwardly through the bottom wall, a stator mounted below the bottom wall of the engine housing and having a central opening, the stator including four sides which provide a generally rectangular periphery, a rotor positioned within the central opening of the stator and attached to the drive shaft of the engine, the rotor including a fan, a generator housing enclosing the rotor and the stator and having an air inlet opening and an air outlet opening, the generator housing including upper and lower portions, the lower portion including four side walls which surround the stator, the upper portion including the front wall and a generally horizontally extending connecting wall which connects the front wall to the lower portion of the generator housing, said air inlet opening being located in the connecting wall and said air outlet opening being located in the lower portion of the generator housing, and means for directing air flow from the air inlet opening, through the central opening of the stator, and through the air outlet opening.

17. The generator assembly of claim 16, wherein said front wall of the generator housing extends generally parallel to a diagonal of the four sides of the lower portion and said connecting wall connects the front wall to two adjacent side walls of the lower portion.

18. The generator assembly of claim 17, wherein the air outlet opening is located in a side wall of the lower portion which is not one of said two adjacent side walls.

19. The generator assembly of claim 17, wherein the air inlet opening includes plural air inlet openings located on two of the side walls of the lower portion which are not said two adjacent side walls.

20. The generator assembly of claim 16, wherein the lower portion of the generator housing includes a bottom wall which extends below the stator and the rotor.

21. The generator assembly of claim 16, wherein the fan on the rotor is positioned below the stator.

22. The generator assembly of claim 16, wherein the stator includes four sides which provide a generally rectangular periphery, and said generator assembly further comprises a gasket disposed between the four side walls of the lower portion of the generator housing and the four side walls of the stator, said gasket directing air from the air inlet opening through the central opening of the stator, and through the air outlet opening.

23. A vertical generator assembly comprising:

an engine including an engine housing and a vertical drive shaft, the engine housing comprising a bottom wall having a predetermined mounting configuration, the vertical drive shaft extending downwardly through the bottom wall, a support frame located below the bottom wall of the engine housing and including a top wall having top and bottom surfaces and an opening therethrough, the top surface facing toward the bottom wall of the engine housing, and the drive shaft of the engine extending through the opening in the top wall of the support frame, a plurality of fasteners attaching the top wall of the support frame to the predetermined mounting configuration of the bottom wall of the engine housing, a stator located below the top wall of the support frame and having a central opening, a plurality of fasteners attaching the stator to the top wall of the support frame, a rotor positioned within the central opening of the stator and attached to the drive shaft of the engine, and a generator housing attached to the top wall of the support frame by a plurality of fasteners, such that the generator housing and the top wall of the support frame enclose the rotor and the stator, the generator housing including an air inlet opening, an air outlet opening, and means for directing air flow from the air inlet opening, through the central opening in the stator, and through the air outlet opening, said air directing means including a gasket disposed between the stator and the generator housing.

24. The generator assembly of claim 23, wherein the rotor includes a fan positioned below the stator.

25. The generator assembly of claim 23, wherein the engine mounting configuration is asymmetrical.

26. A vertical generator assembly comprising:

an engine including an engine housing and a vertical drive shaft, the engine housing including a bottom wall having a predetermined mounting configuration, the vertical drive shaft extending downwardly through the bottom wall, a support frame located below the bottom wall of the engine housing and including a top wall having top and bottom surfaces and an opening therethrough, the top surface facing toward the bottom wall of the engine housing, the drive shaft of the engine extending through the opening in the top wall of the support frame, a plurality of fasteners attaching the top wall of the support frame to the predetermined mounting configuration of the bottom wall of the engine housing, a stator located below the top wall of the support frame, the stator including four sides which provide a generally rectangular periphery and a central opening, a plurality of fasteners attaching the stator to the top wall of the support frame, a rotor positioned within the central opening of the stator and attached to the drive shaft of the engine, and a generator housing attached to the top wall of the support frame by a plurality of fasteners, such that the generator housing and the top wall of the support frame enclose the rotor and the stator, the generator housing including an outer wall which provides a generally rectangular enclosure which surrounds the stator, the outer wall having an air inlet opening that allows air to flow through the outer wall and toward at least one of the sides of the stator and an air outlet opening that allows air to flow away from the stator and through the outer wall, the air inlet opening and the air outlet opening being on different sides of the stator.

27. The generator assembly of claim 26, further comprising a gasket disposed between the stator and the generator housing, said gasket directing air from the air inlet opening, through the central opening in the stator, and through the air outlet opening.

28. The generator assembly of claim 26, wherein the generator housing includes a bottom wall which extends below the stator and the rotor.

29. The generator assembly of claim 26, wherein the engine mounting configuration is asymmetrical.

30. A vertical generator assembly comprising:

an engine including an engine housing and a vertical drive shaft, the engine housing including a bottom wall having a predetermined mounting configuration, the vertical drive shaft extending downwardly through the bottom wall, a support frame attached to the predetermined mounting configuration of the bottom wall of the engine housing, a stator attached to the support frame and having a central opening, the stator having an upper end facing the support frame and a lower end, a rotor positioned within the central opening of the stator and attached to the drive shaft of the engine, the rotor including a fan positioned below the lower end of the stator, and a generator housing enclosing the rotor and the stator, the generator housing including an air inlet opening and an air outlet opening, and means for directing air flow from the air inlet opening, through the central opening in the stator, and through the air outlet opening, said air flow directing means includes a gasket disposed between the stator and the generator housing.

31. The generator assembly of claim 30, wherein the engine mounting configuration is asymmetrical.

32. A vertical generator assembly comprising:

an engine including an engine housing and a vertical drive shaft, the engine housing including a bottom wall having a predetermined mounting configuration and the vertical drive shaft extending downwardly through the bottom wall, a stator mounted below the bottom wall of the engine housing and having a central opening, a rotor positioned within the central opening of the stator and attached to the drive shaft of the engine, the rotor including a fan, a generator housing enclosing the rotor and the stator and having an air inlet opening and an air outlet opening, and means for directing air flow from the air inlet opening, through the central opening of the stator, and through the air outlet opening, said air flow directing means including a gasket disposed between the stator and the generator housing.

33. The generator assembly of claim 32, wherein the engine mounting configuration is asymmetrical.

34. A vertical generator assembly comprising:

an engine including an engine housing and a vertical drive shaft, the engine housing including a bottom wall having a predetermined mounting configuration and the vertical drive shaft extending downwardly through the bottom wall, a stator mounted below the bottom wall of the engine housing, the stator including four sides which provide a generally rectangular periphery and a central opening, a rotor positioned within the central opening of the stator and attached to the drive shaft of the engine, the rotor including a fan, a generator housing enclosing the rotor and the stator and having an air inlet opening and an air outlet opening, the generator housing including an outer wall which provides a generally rectangular enclosure which surrounds the stator, the air inlet opening and the air outlet opening of the generator housing being located on different sides of the stator, and means for directing air flow from the air inlet opening, through the central opening of the stator, and through the air outlet opening.

35. The generator assembly of claim 34, wherein the engine mounting configuration is asymmetrical.

36. A vertical generator assembly comprising:

an engine including an engine housing and a vertical drive shaft, the engine housing including a bottom wall having a predetermined mounting configuration and the vertical drive shaft extending downwardly through the bottom wall, a stator mounted below the bottom wall of the engine housing, the stator including four sides which provide a generally rectangular periphery and a central opening, a rotor positioned within the central opening of the stator and attached to the drive shaft of the engine, the rotor including a fan, a generator housing enclosing the rotor and the stator and having an air inlet opening and an air outlet opening, the generator housing including upper and lower portions, the lower portion including four side walls which surround the stator, the upper portion including a front wall and a generally horizontally extending connecting wall which connects the front wall to the lower portion of the generator housing, said air inlet opening being located in the connecting wall and said air outlet opening being located in the lower portion of the generator housing, and means for directing air flow from the air inlet opening, through the central opening of the stator, and through the air outlet opening.

37. The generator assembly of claim 36, wherein said front wall of the generator housing extends generally parallel to a diagonal of the four sides of the lower portion and said connecting wall connects the front wall to two adjacent side walls of the lower portion.

38. The generator assembly of claim 37, wherein the air outlet opening is located in a side wall of the lower portion which is not one of said two adjacent side walls.

39. The generator assembly of claim 37, wherein the air inlet opening includes plural air inlet openings located on two of the side walls of the lower portion which are not said two adjacent side walls.

40. The generator assembly of claim 36, wherein the lower portion of the generator housing includes a bottom wall which extends below the stator and the rotor.

41. The generator assembly of claim 36, wherein the fan on the rotor is positioned below the stator.

42. The generator assembly of claim 36, wherein the stator includes four sides which provide a generally rectangular periphery, and said generator assembly further comprises a gasket disposed between the four side walls of the lower portion of the generator housing and the four side walls of the stator, said gasket directing air from the air inlet opening through the central opening of the stator, and through the air outlet opening.

43. The generator assembly of claim 36, wherein the engine mounting configuration is asymmetrical.

44. A vertical generator assembly for use with an engine including an engine housing and a vertical drive shaft, the engine housing having a bottom wall including a flange having a standard lawn mower mounting configuration and the vertical drive shaft extending downwardly through the bottom wall, said vertical generator assembly comprising:

a support frame having a mounting configuration the same as the mounting configuration of the flange of the engine housing, a stator attached to the support frame and having a central opening, the stator having an upper end facing the support frame and a lower end, a rotor attachable to the vertical drive shaft of the engine and disposable within the central opening of the stator so that, when the engine is mounted on the support frame, the rotor is positioned within the central opening of the stator and freely rotatable therein, and a generator housing attached to the support frame and enclosing the stator and rotor.

45. The generator assembly of claim 44, wherein the rotor includes a fan at a distal end thereof, such that, when the rotor is attached to the vertical drive shaft of the engine, the fan is positioned below a lower end of the stator, and the generator housing encloses the stator, the rotor and the fan.

46. The generator assembly of claim 45, wherein the generator housing includes an air inlet opening and an air outlet opening, and means for directing air flow from the air inlet opening, through the central opening in the stator, and through the air outlet opening.

47. The generator assembly of claim 46, wherein said air flow directing means includes a gasket disposed between the stator and the generator housing.

48. The generator assembly of claim 44, wherein the generator housing includes an air inlet opening and an air outlet opening, and means for directing air flow from the air inlet opening, through the central opening in the stator, and through the air outlet opening.

49. The generator assembly of claim 48, wherein said air flow directing means includes a gasket disposed between the stator and the generator housing.

50. A vertical generator assembly for use with an engine including an engine housing and a vertical drive shaft, the engine housing having a bottom wall including a flange having a predetermined mounting configuration and the vertical drive shaft extending downwardly through the bottom wall, said vertical generator assembly comprising:

a support frame having a mounting configuration the same as the mounting configuration of the flange of the engine housing, a stator attached to the support frame and having a central opening, the stator having an upper end facing the support frame and a lower end, a rotor attachable to the vertical drive shaft of the engine and disposable within the central opening of the stator so that, when the engine is mounted on the support frame, the rotor is positioned within the central opening of the stator and freely rotatable therein, and a generator housing attached to the support frame and enclosing the stator and rotor.

51. The generator assembly of claim 50, wherein the rotor includes a fan at a distal end thereof, such that, when the rotor is attached to the vertical drive shaft of the engine, the fan is positioned below a lower end of the stator, and the generator housing encloses the stator, the rotor and the fan.

52. The generator assembly of claim 51, wherein the generator housing includes an air inlet opening and an air outlet opening, and means for directing air flow from the air inlet opening, through the central opening in the stator, and through the air outlet opening.

53. The generator assembly of claim 52, wherein said air flow directing means includes a gasket disposed between the stator and the generator housing.

54. The generator assembly of claim 50, wherein the generator housing includes an air inlet opening and an air outlet opening, and means for directing air flow from the air inlet opening, through the central opening in the stator, and through the air outlet opening.

55. The generator assembly of claim 54, wherein said air flow directing means includes a gasket disposed between the stator and the generator housing.

* * * * *